US012497845B2

(12) United States Patent
Infante

(10) Patent No.: US 12,497,845 B2
(45) Date of Patent: Dec. 16, 2025

(54) METHODS AND APPARATUS FOR ENGAGING TUBULARS

(71) Applicant: TUBULAR RUNNING & RENTAL SERVICES, LLC, Fulshear, TX (US)

(72) Inventor: Jairo Gutierrez Infante, Funza (CO)

(73) Assignee: Tubular Technology Tools, LLC, Fulshear, TX (US)

( * ) Notice: Subject to any disclaimer, the term of this patent is extended or adjusted under 35 U.S.C. 154(b) by 0 days.

(21) Appl. No.: 18/577,287

(22) PCT Filed: Jul. 9, 2022

(86) PCT No.: PCT/US2022/036594

§ 371 (c)(1),
(2) Date: Jan. 8, 2024

(87) PCT Pub. No.: WO2023/287667

PCT Pub. Date: Jan. 19, 2023

(65) Prior Publication Data

US 2024/0384612 A1 Nov. 21, 2024

Related U.S. Application Data

(60) Provisional application No. 63/220,699, filed on Jul. 12, 2021.

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/161
See application file for complete search history.

(56) References Cited

U.S. PATENT DOCUMENTS

| | | | | |
|---|---|---|---|---|
| 7,062,991 | B1 | 6/2006 | West et al. | |
| 10,538,976 | B2 * | 1/2020 | Scekic | E21B 19/163 |
| 2010/0187740 | A1 | 7/2010 | Orgeron | |
| 2013/0255446 | A1 * | 10/2013 | Taggart | E21B 19/161 81/57.11 |
| 2014/0360736 | A1 | 12/2014 | Angelle et al. | |
| 2019/0153793 | A1 * | 5/2019 | Bouligny | E21B 19/161 |
| 2021/0293091 | A1 * | 9/2021 | Mikalsen | E21B 17/00 |
| 2021/0363838 | A1 * | 11/2021 | Magnuson | E21B 19/163 |

OTHER PUBLICATIONS

PCT International Search Report and Written Opinion, issued Oct. 4, 2022.

* cited by examiner

*Primary Examiner* — Nicole Coy
*Assistant Examiner* — Nicholas D Wlodarski
(74) *Attorney, Agent, or Firm* — Victor H. Segura

(57) ABSTRACT

A platform equipped with multiple moving jaws to receive and engage tubing and casing. The platform may be mounted above a wellbore to securely hold a tubing or casing segment, preventing the segment from rotating or slipping as torque is applied to an adjacent tubing or casing segment. Methods of engaging tubing and casing using the platforms as torque is applied during makeup or loosening operations.

13 Claims, 7 Drawing Sheets

METHODS AND APPARATUS FOR ENGAGING TUBULARS

CROSS-REFERENCE TO RELATED APPLICATIONS

Continuation of International Application No. PCT/US2022/036594 filed Jul. 9, 2022. Priority is claimed from U.S. Provisional Application No. 63/220,699 filed on Jul. 12, 2021. Both foregoing applications are incorporated herein by reference in their entirety.

FIELD OF THE INVENTION

The present disclosure relates generally to methods and apparatus for manipulating tubulars, and more particularly, to techniques for engaging (making up or loosening) tubing and casing while tripping in or out of a subsurface wellbore.

BACKGROUND

The drilling and completion of subsurface wells involves assembling tubing and casing strings, each of which entail multiple elongated, heavy tubular segments. Typically, the casing string is disposed in the wellbore to line the wellbore after drilling the hole, to ensure the integrity of the wellbore. The casing string consists of multiple casing segments coupled together by a threadform, known as a connection, formed at each end of the individual segments.

Conventional techniques for assembling casing strings entail the use of large manual wrenches (commonly referred to as Mechanical Casing Tongs) to grip casing segments to apply torque. The mechanical casing tongs are used in opposing pairs, one set of tongs is essentially anchored with a cable or chain to the derrick, and the other is mechanically pulled. The tongs are used during makeup (tightening) operations or during loosening operations, to dispose the casing into or out of the wellbore. Hydraulic casing tongs are also employed to handle low and high torque casing, while making up each connection. The hydraulic tongs also employ a hydraulic Backup System to hold the tubulars while making up connections.

While such conventional Mechanical Tongs and Backup Systems facilitate the assembly of casing strings, such tools suffer from shortcomings. One such shortcoming is that these tools are bulky and pose a risk of personal injury to the rig personnel operating the equipment and running the casing into the wellbore. Thus, a need remains for improved techniques to efficiently and safely manipulate casing tubulars for disposal in subsurface wellbores.

BRIEF DESCRIPTION OF THE DRAWINGS

The following figures further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements.

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

Figure 1:
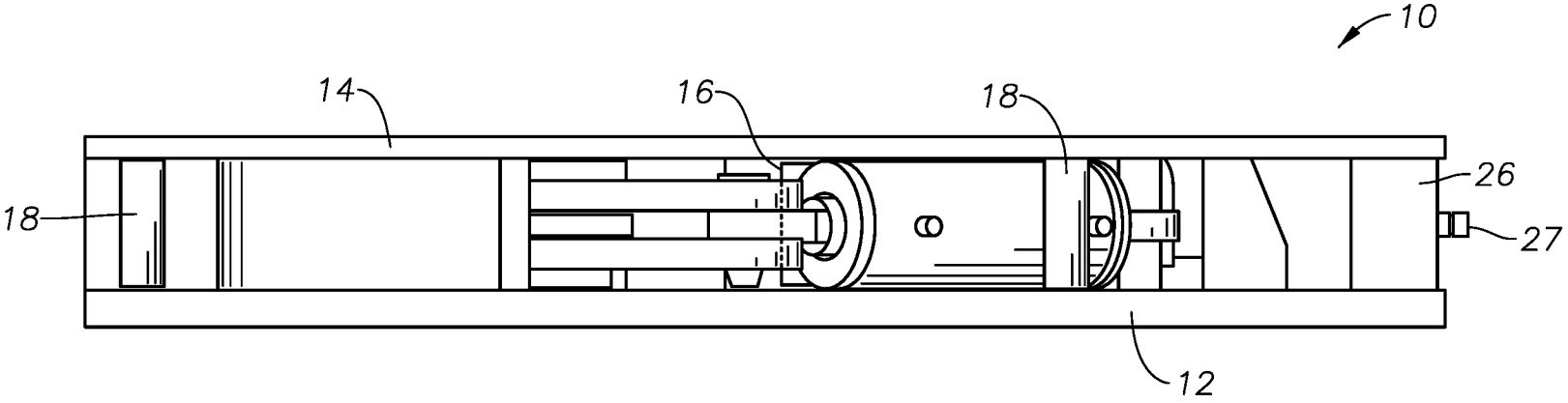
FIG. 1 shows a schematic side view of a platform according to an example of the present disclosure.

FIG. 1 shows a side view schematic of a platform 10 embodiment of this disclosure. The platform 10 includes a planar base 12 and a planar top 14. A central moveable jaw 16 is mounted in between the base 12 and top 14. Multiple support posts 18 are disposed between the base 12 and top 14. The posts 18 may be positioned and distributed between the base 12 and top 14 to provide connection points to hold the top 14 in place, as further described herein. The base 12, top 14, and posts 18 may be formed of any suitable material to support the desired loading (e.g. steel).

Figure 2:
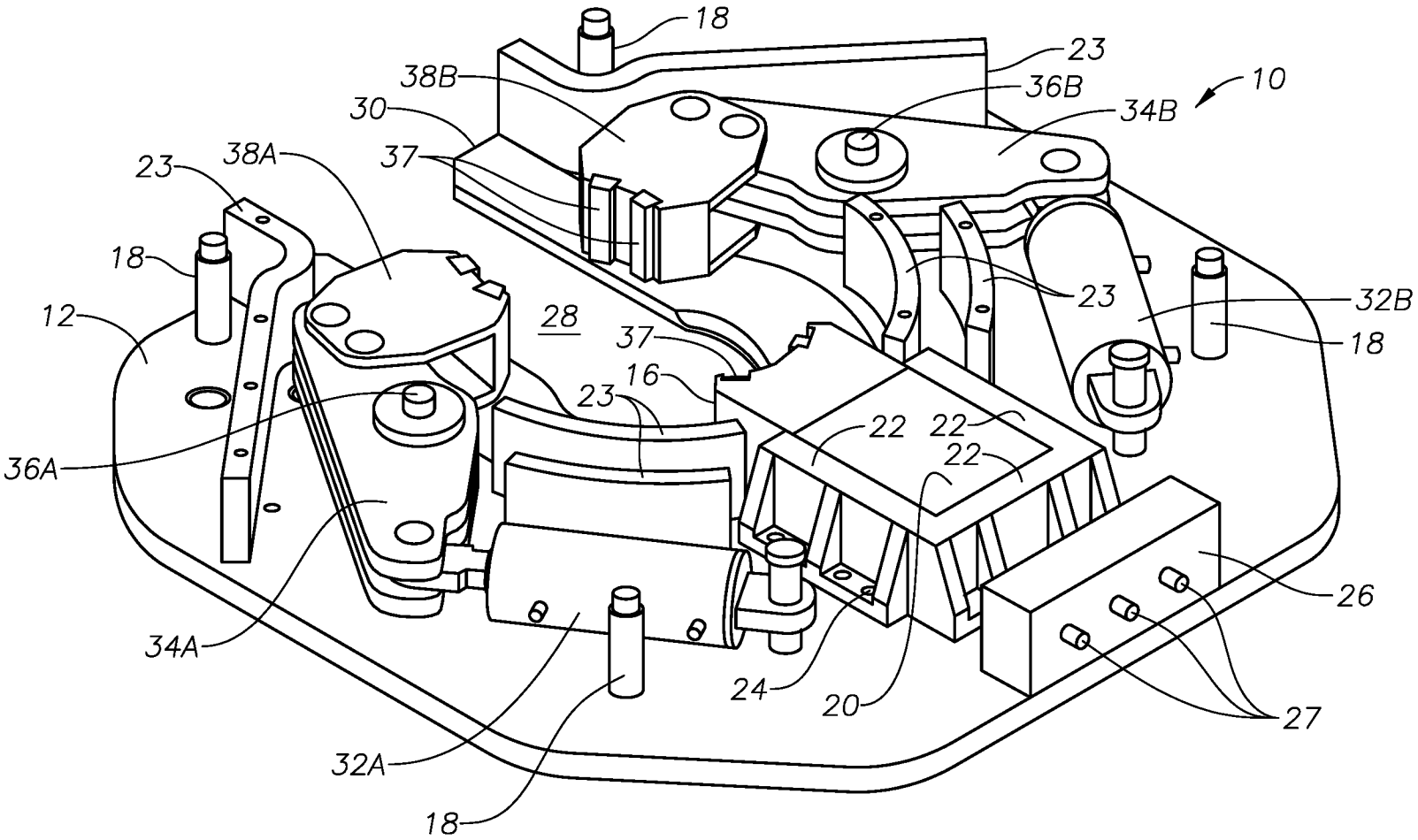
FIG. 2 shows a perspective cutaway view of a platform according to an example of the present disclosure.

FIG. 2 shows a perspective cutaway view of a platform 10 embodiment of this disclosure. The central moveable jaw 16 is coupled to a hydraulic actuator 20. The hydraulic actuator 20 is cupped by support walls 22 extending upward from and rigidly mounted on the base 12. Multiple ribs 23 are disposed between the base 12 and top 14. The ribs 23 and support walls 22 may be affixed to the base 12 using conventional fasteners 24 (e.g. bolts). In some embodiments, the ribs 23 and support walls 22 may be welded to the base 12 or formed as a unitary part of the base 12 during the fabrication process. In some embodiments, a distribution block 26 is mounted on the base 12. The distribution block 26 is configured with conventional porting and couplers 27 to facilitate the connection of external supply lines (e.g., hydraulic fluid, electric power, air) to provide the internal platform 10 components the necessary means for actuation as applicable. For clarity of illustration, the hoses and feeds running from the distribution block 26 to the platform 10 components are not shown. It will be appreciated by those skilled in the art that conventional conduits and connectors may be used to implement embodiments of this disclosure.

As shown in FIG. 2, the base 12 is configured with an opening 28 formed therein, extending from one side of the base toward the center of the base. Different platforms 10 may be configured with openings 28 having different widths, to receive tubulars of different outside diameters as used in the field. The opening 28 is formed such that the base 12 is configured substantially C-shaped. In some embodiments, a lower guide plate 30 is mounted on the base 12 to coincide with the opening 28 formed in the base. The lower guide plate 30 may be swapped and replaced with a guide plate having a different size opening 28 to accommodate and guide tubulars and casing having different outside diameters.

A pair of hydraulic cylinders 32A, 32B are mounted on the base 12 to actuate and move corresponding articulated arms 34A, 34B coupled to the respective cylinder. Each articulated arm 34A, 34B is respectively mounted on the base 12 with a mounting pin 36A, 36B that allows the arm to pivot, as described below. Each articulated arm 34A, 34B has a corresponding movable jaw 38A, 38B coupled on the end of the arm nearest to the opening 28. In some embodiments, one or more inserts 37 may be affixed on the outer face of each movable jaw 38A, 38B to provide an abrasive or non-smooth surface. In some embodiments, the outer face of each movable jaw 38A, 38B may be configured with a gripping portion formed via conventional techniques as known in the art (e.g., knurled surface, layer deposition, chemical treatment, shot peening, etc.).

Some embodiments may also be configured with interchangeable movable jaws 16, 38A, 38B for use with particular tubulars (e.g., tubulars with specialized connection geometries, special coatings, etc.). Some platforms 10 will vary in height and weight to accommodate bases 12, tops 14, hydraulic cylinders 32A, 32B, and articulated arms 34A, 34B of different sizes and tolerances depending on the weight to be supported (e.g., some platforms 10 may be rated at 350-800 tons capacity). The platform 10 embodiment in FIG. 2 is shown in the neutral mode, with the movable jaws 16, 38A, 38B in a retracted position.

Figure 3:
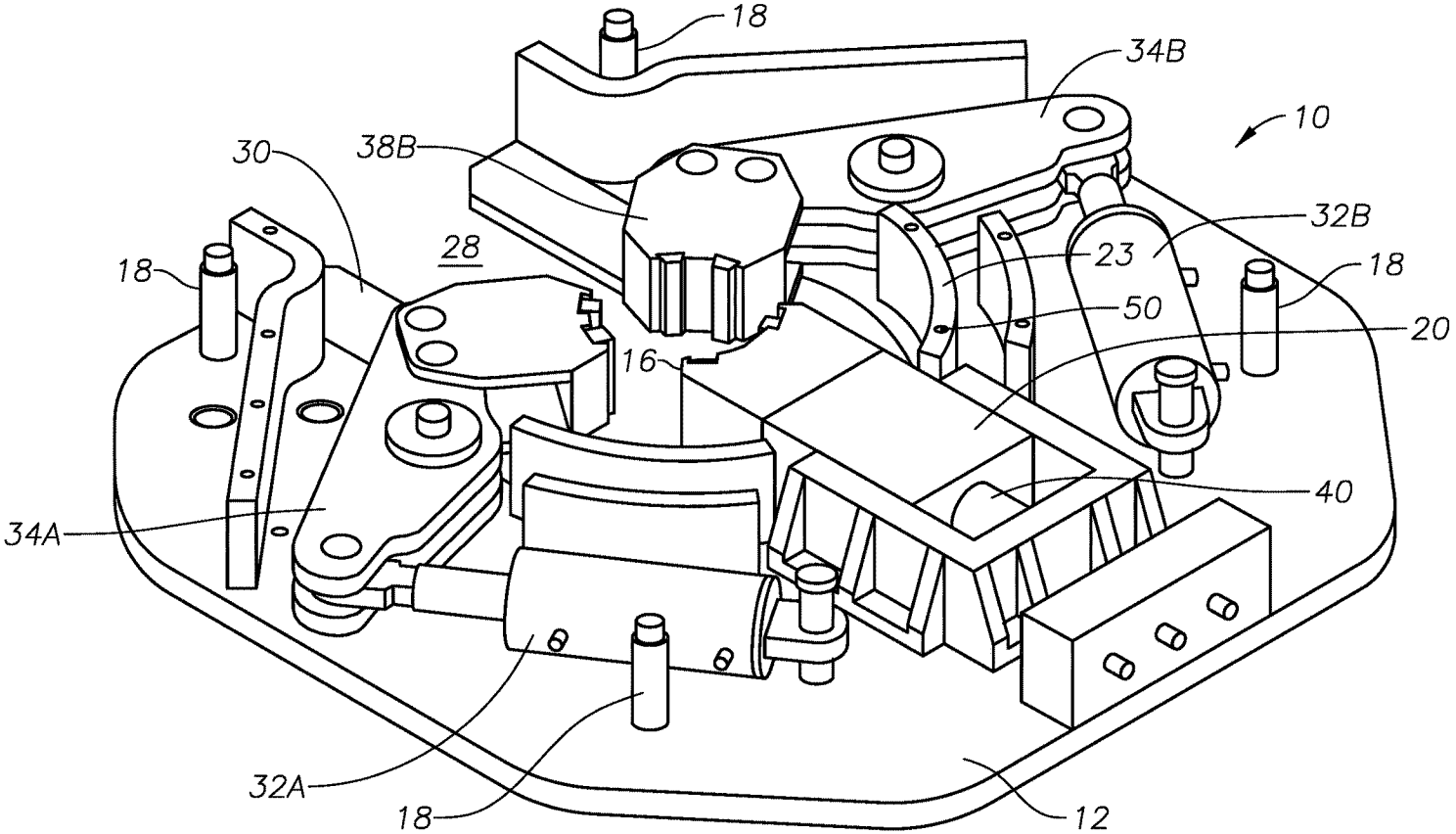
FIG. 3 shows another perspective cutaway view of the platform of FIG. 2 according to an example of the present disclosure.

FIG. 3 shows a perspective cutaway view of the platform 10 embodiment of FIG. 2 in an actuated mode, with the movable jaws 16, 38A, 38B in an extended position. In operation, the hydraulic actuator 20 is actuated with hydraulic fluid pressure (e.g., via an external hydraulic fluid feed through a coupler 27 on distribution block 26), causing a piston 40 to extend from the actuator 20 to push off the back support wall 22. As the piston 40 extends from the actuator 20, the central moveable jaw 16 correspondingly moves into the opening 28. The hydraulic cylinders 32A, 32B are likewise actuated with hydraulic fluid pressure to extend, causing the linked articulated arms 34A, 34B to pivot about the mounting pins 36A, 36B, which in turn moves the moveable side jaws 38A, 38B into the opening 28. As shown in FIG. 3, platform 10 embodiments may be implemented with the connection posts 18 affixed to the base 12 (e.g. via bolts or welding) to provide the connection points to hold the top 14 securely affixed in place (see FIG. 5).

Figure 4:
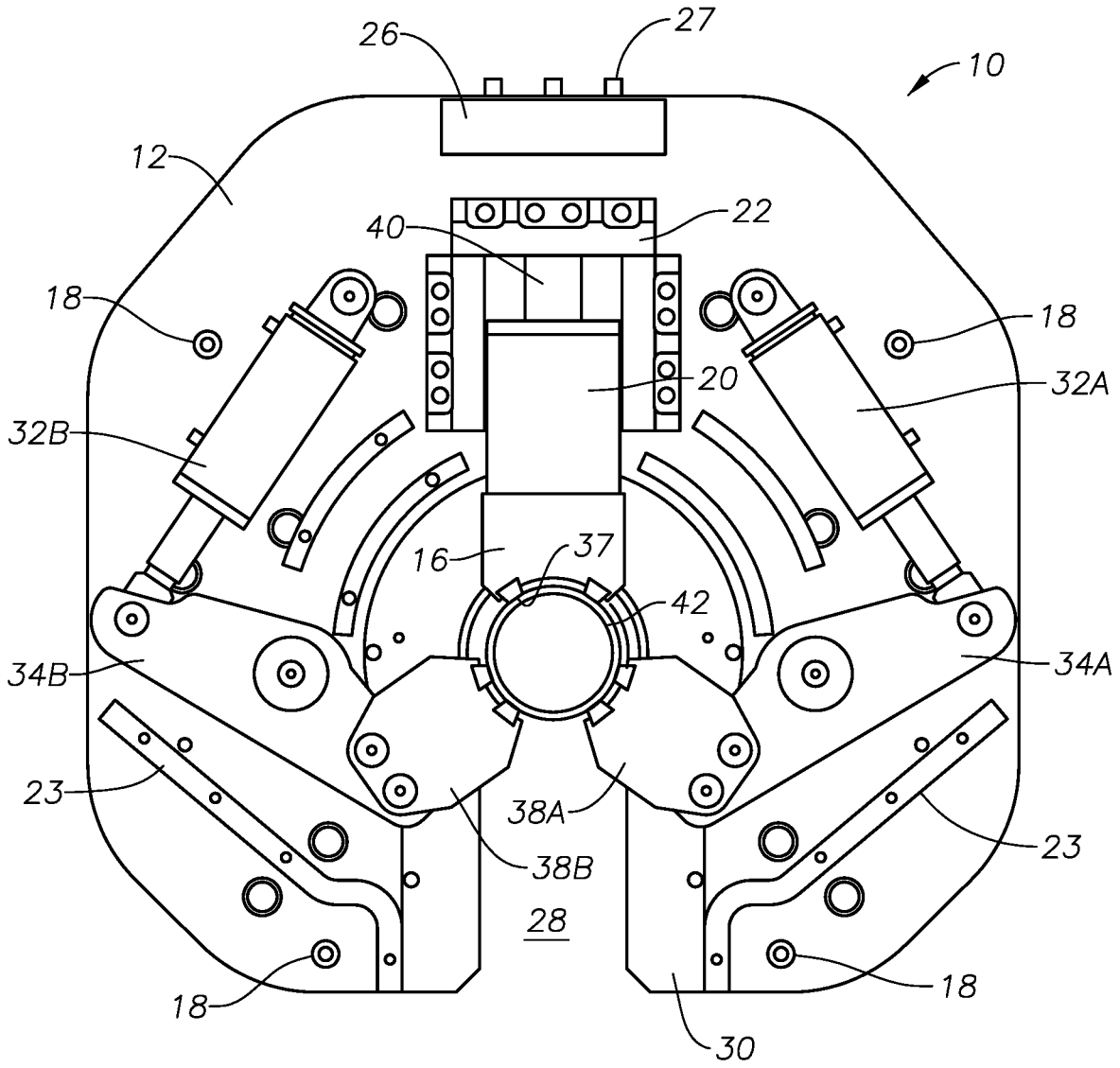
FIG. 4 shows a top view schematic of a platform according to examples of the present disclosure.

Turning to FIG. 4, an overhead schematic of a platform 10 embodiment is shown in the actuated mode. A tubular 42 (e.g. a casing segment) is securely engaged by the extended moveable jaws 16, 38A, 38B. The hydraulic actuator 20 and the hydraulic cylinders 32A, 32B respectively convey sufficient pressure to the moveable jaws 16, 38A, 38B to hold the casing or tubular 42 in place and keep it from slipping or rotating while being torqued when another tubular segment is added to or removed from tubular being held in the jaws (e.g., torque up to 150,000 ft-lbs (203,373 Nm) on casing with 36 inch (91.44 cm) outside diameter).

Figure 5:
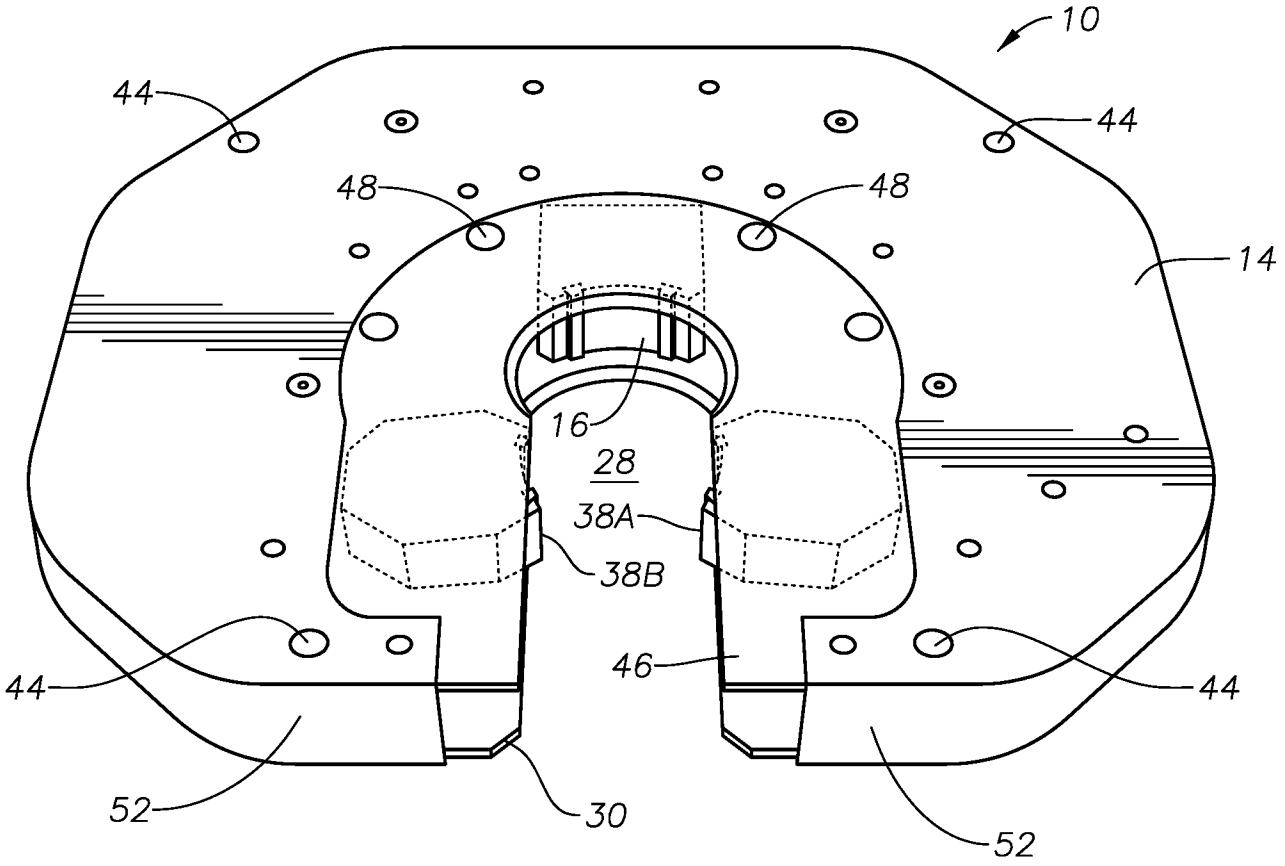
FIG. 5 shows a perspective view of a platform according to examples of the present disclosure.

FIG. 5 shows a perspective view of a platform 10 of this disclosure. The platform 10 is shown fully assembled, with the top 14 secured to the base 12 via bolts 44 inserted into posts 18 (see FIG. 3) configured with internal threads. Embodiments may also be implemented with an upper guide plate 46 mounted to the top 14 to coincide with the opening 28 formed in the top. In some embodiments, the upper guide plate 46 may be secured to the platform 10 via one or more bolts 48 engaging with threaded holes 50 formed on one or more ribs 23 (see FIG. 3). The lower guide plate 30 may be similarly secured to the base 12. As with the lower guide plate 30, the upper guide plate 46 may be swapped and replaced with a guide plate having a different size opening 28 to receive and guide tubing and casing having different outside diameters.

As shown in FIG. 5, when the base 12 and top 14 are aligned with one another, the platform provides a main opening 28 to receive and accommodate a tubular therein. In some embodiments, the base 12 or the top 14 may be configured with a raised wall 52 running along the periphery to provide full enclosure of the platform 10 when the base and top are joined. In some embodiments, the raised wall 52 may be a stand-alone component securely affixed (e.g. via bolts, welded) to either the base 12 or the top 14. In some embodiments, the raised wall 52 is welded to the base 12 and bolted to the top 14, to facilitate disassembly for maintenance. In other embodiments, the raised wall 52 may be formed of multiple sections securely affixed (e.g. via bolts, welded) to either the base 12 or the top 14.

Figure 6:
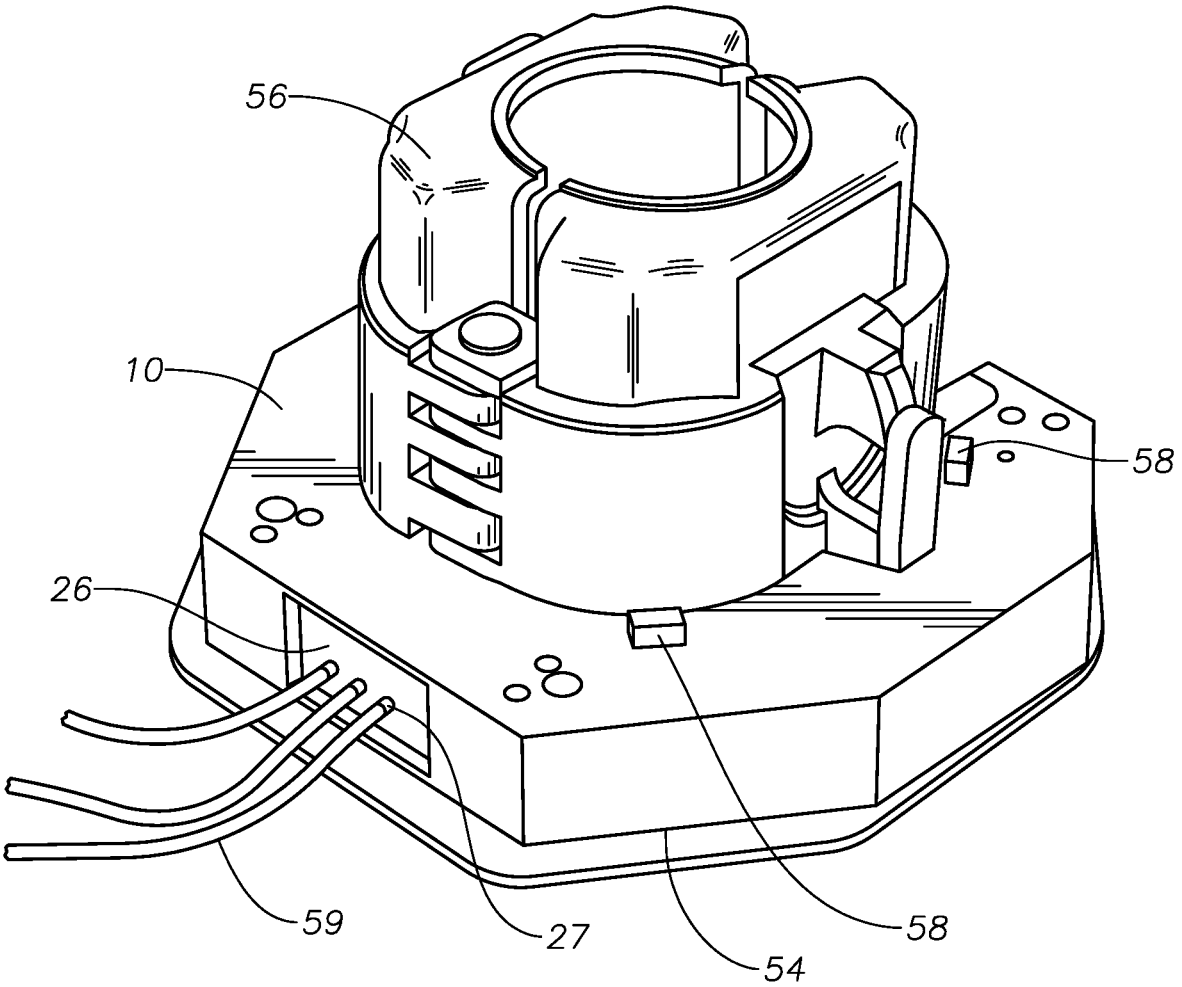
FIG. 6 shows a schematic of a system configuration for engaging a tubular at a rotary table using a platform coupled to a casing spider unit at a well site according to examples of the present disclosure.

FIG. 6 shows a platform 10 embodiment of this disclosure disposed over a conventional rotary table 54 arranged over a wellbore at a rig floor at a well site. A conventional "Casing Spider" unit 56 is disposed on top of the platform 10. The Casing Spider unit 56 is used to support the weight of a string of tubulars disposed in the wellbore. When used in conjunction with the platform 10 embodiments of this disclosure, the Casing Spider unit 56 may be used to sustain the weight of the casing string in the wellbore while the platform maintains the casing segment, engaged by the moveable jaws 16, 38A, 38B, from rotating or slipping while torque is applied during makeup or loosening of an adjoining casing or tubing segment. As previously described, the internal ribs 23 of the platform 10 provide the necessary support for the platform to sustain the weight of the Casing Spider unit 56 and the supported casing string. FIG. 6 shows the feed lines 59 linked to the couplers 27 on the platform 10 distribution block 26 to provide the hydraulic fluid to actuate the internal moveable jaws 16, 38A, 38B. The feed lines 59 may be coupled to a control module to provide fluids (e.g. hydraulic fluid, air pressure), electrical power, and/or signal communications under control of an operator. In some embodiments, the control module comprises a hydraulic power unit under the control of an operator.

Figure 7:
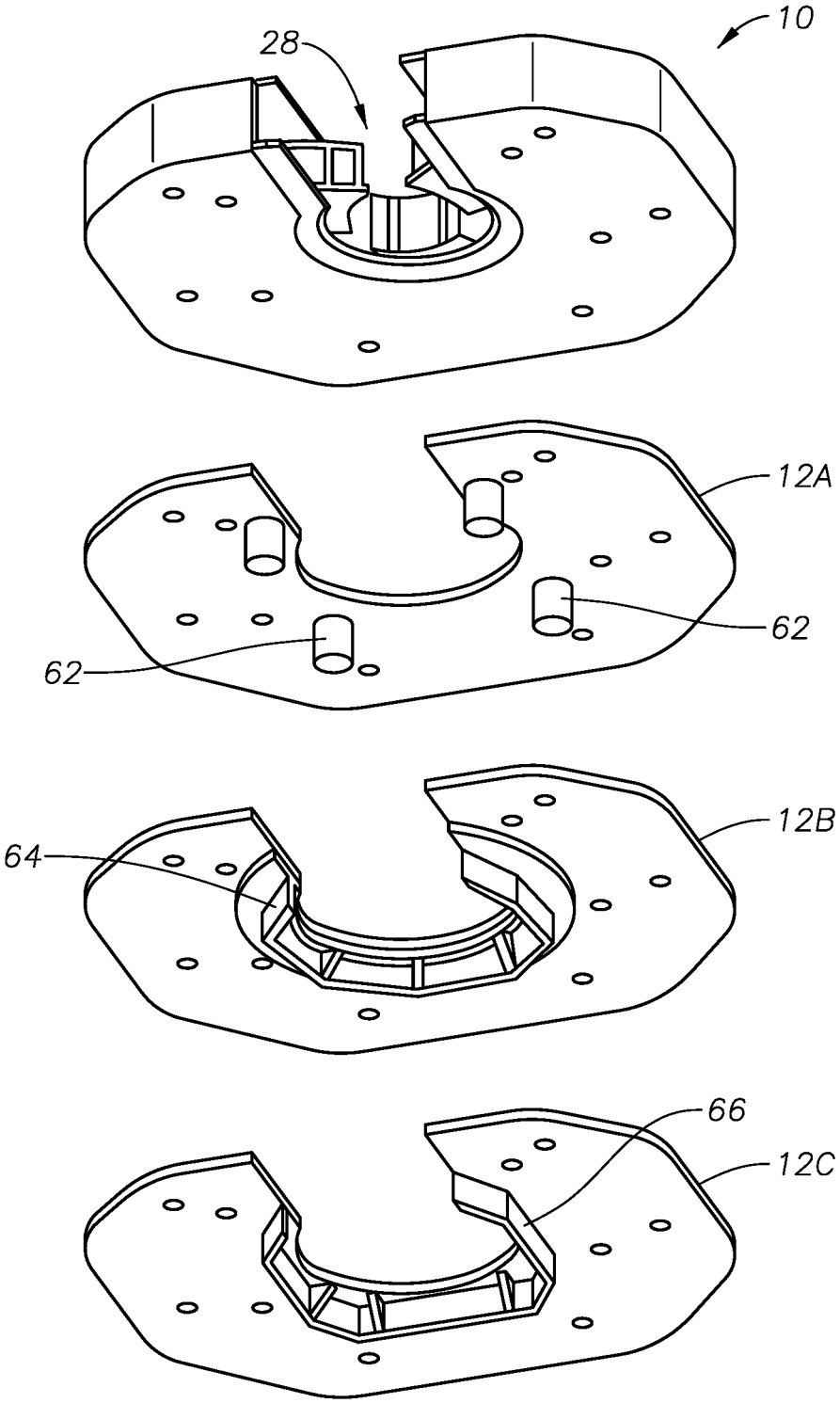
FIG. 7 shows a schematic of multiple platform base plate configurations to install the platforms on any different type of rotary table according to examples of the present disclosure.

The platform 10 may be secured to the rotary table 54 and master bushing at the drill floor in various ways. FIG. 6 shows the platform 10 secured to the rotary table 54 via multiple securing bolts 58 running through the platform body into threaded receptacles in the table. FIG. 7 shows other platform 10 bases that can be implemented to connect and secure the platform to master bushings in rotary tables 54. Base 12A is configured with multiple connection stands 62 extending from the bottom surface of the base to engage with rotary tables configured to receive the stands. Base 12B is configured with a contoured lip 64 extending from the bottom surface of the base along the periphery of the opening 28 to engage with rotary tables configured to receive the lip. Base 12C is configured with another contoured lip 66 extending from the bottom surface of the base along the periphery of the opening 28 to engage with rotary tables configured to receive such a lip. In some embodiments, the bases 12A, 12B, 12C may be formed as additional unitary plates that can be affixed to the bottom of the bases 12 (e.g. via bolts) of the platforms 10 disclosed herein. In other embodiments, the platform 10 bases 12 may be formed with the bottom surface configurations of bases 12A, 12B, or 12C. It will be appreciated by those skilled in the art that platform 10 embodiments of this disclosure may be implemented with base 12 configurations to secure the platform to any API rated rotary tables or master bushings.

It will be appreciated that embodiments of the platform 10 may also be used in other tubular handling operations; they are not limited for use solely above a wellbore. Embodiments of the platform 10 may be permanently fixed at a set location or they can be temporarily installed at a well site for use during specific operations and removed when the operations are completed. In some embodiments, the disclosed platforms 10 may be implemented for operation with spider units that are disposed in the rotary table 54 (commonly referred to as a "Flush Mounted Spider"). In such implementations, the platform 10 may be mounted and secured above the Flush Mounted Spider.

In light of the principles and example embodiments described and depicted herein, it will be recognized that the example embodiments can be modified in arrangement and detail without departing from such principles. Also, the foregoing discussion has focused on particular embodiments, but other configurations are also contemplated. It will be appreciated by those skilled in the art that embodiments may be implemented using conventional software and computer systems programmed to perform the disclosed processes and operations. It will also be appreciated by those skilled in the art that embodiments may be implemented using conventional hardware and electrical mechanical components to provide the linkages, couplings, connections, communications, hydraulic power units, etc., in accordance with the techniques disclosed herein.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A platform to engage a tubular, comprising:

a base having an opening formed therein and configured for placement at a wellbore;

a top disposed over the base, the top having an opening formed therein;

wherein the respective openings on the top and base are aligned with one another to form a main opening;

a plurality of moveable jaws disposed between the top and base to engage with and prevent rotation of a tubular when the tubular is disposed in the main opening, wherein each jaw of the plurality of moveable jaws is individually powered for independent actuation relative to the other jaws;

a plurality of the moveable jaws each being coupled to a pivoting arm configured to respectively extend and retract the jaw into/from the main opening, wherein a plurality of the pivoting arms are each configured for independent actuation relative to the other pivoting arms to extend and retract the coupled moveable jaws;

wherein at least one of the moveable jaws is coupled to an actuator configured to respectively extend and retract the jaw into/from the main opening in a single linear plane;

an internal rib structure between the base and the top to enable the platform to sustain the weight of a string of tubulars disposed in the wellbore; and wherein the platform is configured to sustain the weight of the string of tubulars when the platform is disposed on a rotary table at the wellbore.

2. The platform of claim 1 wherein the plurality of moveable jaws are configured to hold the tubular when torque is applied to the tubular when the tubular is disposed in the main opening.

3. The platform of claim 1 wherein each pivoting arm and the actuator are each hydraulically actuated.

4. The platform of claim 1 wherein the main opening is configured to form a substantially C-shaped gap.

5. The platform of claim 1 further comprising a base guide plate disposed on the base to form the opening on the base and a top guide plate disposed on the top to form the opening on the top.

6. The platform of claim 1 further comprising a distribution block to provide a coupling point for at least one external supply line.

7. The platform of claim 1 wherein the platform is configured to support a spider unit.

8. The platform of claim 1 wherein each jaw of the plurality of moveable jaws includes at least one insert disposed on a face of the jaw.

9. A method for engaging a tubular, comprising:

disposing a platform at a wellbore;

the platform having a base with an opening formed therein and a top with an opening formed therein, wherein the respective openings on the top and base are aligned with one another to form a main opening;

actuating a plurality of moveable jaws disposed between the top and base to engage with and prevent rotation of a tubular disposed in the main opening, wherein each jaw of the plurality of moveable jaws is individually powered for independent actuation relative to the other jaws;

a plurality of the moveable jaws each being coupled to a pivoting arm configured to respectively extend and retract the jaw into/from the main opening, wherein a plurality of the pivoting arms are each configured for independent actuation relative to the other pivoting arms to extend and retract the coupled moveable jaws;

wherein at least one of the moveable jaws is coupled to an actuator configured to respectively extend and retract the jaw into/from the main opening in a single linear plane;

an internal rib structure between the base and the top to enable the platform to sustain the weight of a string of tubulars disposed in the wellbore; and wherein the platform is configured to sustain the weight of the string of tubulars when the platform is disposed on a rotary table at the wellbore.

10. The method of claim 9 wherein the main opening is configured to form a C-shaped platform.

11. The method of claim 9 further comprising linking the platform to a spider unit.

12. The method of claim 9 wherein the at least one moveable jaw coupled to the actuator is configured to extend toward the main opening before the plurality of moveable jaws coupled to the pivoting arms extend toward the opening.

13. The method of claim 9 further comprising providing hydraulic fluid to actuate each jaw of the plurality of moveable jaws.

* * * * *